US005879147A

United States Patent [19]

Suzumori

[11] Patent Number: 5,879,147

[45] Date of Patent: Mar. 9, 1999

[54] ACTUATOR DRIVEN BY PRESSURE CHANGE OF FLUID

[75] Inventor: Koichi Suzumori, Kanagaww-ken, Japan

[73] Assignee: Kabushiki Kaisha Toshiba, Kawasaki, Japan

[21] Appl. No.: 896,054

[22] Filed: Jul. 17, 1997

[30] Foreign Application Priority Data

Aug. 30, 1996 [JP] Japan ..... 8-249321

[51] Int. Cl.[6] ..... F01C 5/00

[52] U.S. Cl. ..... 418/153

[58] Field of Search ..... 418/153

[56] References Cited

U.S. PATENT DOCUMENTS

| | | | |
|---|---|---|---|
| 4,004,865 | 1/1977 | Ikeda et al. | 418/153 X |
| 4,334,842 | 6/1982 | Ikeda et al. | 418/153 X |
| 4,391,572 | 7/1983 | Lew | 418/153 X |
| 4,456,442 | 6/1984 | Gnagnetti | 418/153 |
| 4,923,376 | 5/1990 | Wright | 418/153 X |

OTHER PUBLICATIONS

Iwao Hayashi et al., "An Electromagnetic Cycloid MOtor", Journal of the Japan Society for Precision Engineering, vol. 61, No. 1, pp. 95–99, 1995.

A. Viviani, "Experimental and Theoretical Study of Hypocycloidal Motors with Two–Harmonic Field Windows", IEEE Transactions on Power Apparatus and Systems, vol. PAS–99, No.1, pp.292–300, 1980.

W. Trimmer et al., "An Operational Harmonic Electrostatic Motor", Proc. IEEE Micro Electro Mechanical Systems, pp. 13–16, Feb. 20, 1989.

S.C. Jacobsen et al., "The Wobble Motor: An Electrostatic, Planetary–Armature, Microacutuator", Proc. IEEE Micro Electro Mechanical Systems, pp. 17–24, Feb. 20, 1989.

*Primary Examiner*—Hoang Nguyen

*Attorney, Agent, or Firm*—Finnegan, Henderson, Farabow, Garrett & Dunner, L.L.P.

[57] ABSTRACT

The actuator of the present invention is driven by pressure changes of the fluid. A first structural body as an elastic body includes a plurality of pressure chambers along an axis direction. The first structural body passes through a second structural body, an annulus ring, with a predetermined gap between an outer surface of the first structural body and an inner surface of the second structural body. A supply unit sequentially supples fluid to the plurality of pressure chambers. A pressure welding position between the outer surface of the first structural body and the inner surface of the second structural body is sequentially changed by unit of the pressure chamber. Therefore, the second structural body rotates in response to changes of the pressure welding position.

14 Claims, 8 Drawing Sheets

ACTUATOR DRIVEN BY PRESSURE CHANGE OF FLUID

FIELD OF THE INVENTION

The present invention relates to an actuator driven by the pressure change of a supplied fluid, the location of which can be identified with high accuracy.

BACKGROUND OF THE INVENTION

An actuator effectively generates power. Especially, the actuator of a fluid driving system is widely used. This actuator is driven by pressure changes in the fluid. Well known examples include oil hydraulic actuators and pneumatic actuators. The structure of these actuators is simple. In addition to this benefit, the actuators are lightweight and inexpensive. Therefore, this kind of actuator is used in piston cylinders and a vane motor.

However, in order to effectively lead the power from the actuator, a seal for the activated fluid is necessary as a structure of the actuator. The seal is a packing between the cylinder and the piston. Friction generated in the actuator is large when the actuator is activated by a pressure change of the fluid. Accordingly, it is impossible to identify the location of the actuator with high accuracy.

For example, FIG. 1 is a horizontal sectional plan of a pneumatic actuator according to the prior art. The pneumatic actuator includes a piston, a cylinder and a plurality of seals connected between the piston and the cylinder. When fluid A is supplied to the cylinder, the piston moves to position A of the cylinder along move direction A. When fluid B is supplied to the cylinder, the piston moves to position B of the cylinder along move direction B. In short, by changing the supply of the fluid A and the fluid B, the piston is moved between position A and position B. Therefore, for example, if the piston is connected to an automatic door of a bus, the opening and closing of the automatic door is controlled by changing position A to position B or vice versa A. However, in this pneumatic actuator, a plurality of seals leads big friction between the piston and the cylinder. Therefore, even if the piston moves between the position A and the position B of the cylinder, only two positions (position A and position B) can be used to generate automatic power for other equipment (the automatic door). In other words, it is impossible to identify with high accuracy and use a large number of positions to generate automatic power.

SUMMARY OF THE INVENTION

It is an object of the present invention to provide an actuator, the location of which can be identified with high accuracy in comparison with the prior art.

It is another object of the present invention to provide an actuator which generates big torque.

According to the present invention, there is provided an actuator, comprising: a first structural body as an elastic body in which a plurality of pressure chambers are included along the axis direction; a second structural body as annulus ring through which said first structural body passes with a predetermined gap between the outer surface of said first structural body and the inner surface of said second structural body; and a supply means for the successive supplying of fluid to the plurality of pressure chambers, the pressure contact point between the outer surface of said first structural body and the inner surface of said second structural body is successively changed by unit of the pressure chamber to rotate said second structural body.

Further in accordance with the present invention, there is provided an actuator, comprising: a first structural body of tubular shape in which a plurality of pressure chambers are included along the axis direction; a second structural body passed through said first structural body with a predetermined gap between the inner surface of said first structural body and the outer surface of said second structural body, and a supply means for successively supplying fluid to the plurality of pressure chambers, the pressure contact point between the inner surface of said first structural body and the outer surface of said second structural body is successively changed by unit of the pressure chamber to rotate said second structural body.

DETAILED DESCRIPTION OF THE PREFERRED EMBODIMENT

Figure 1:
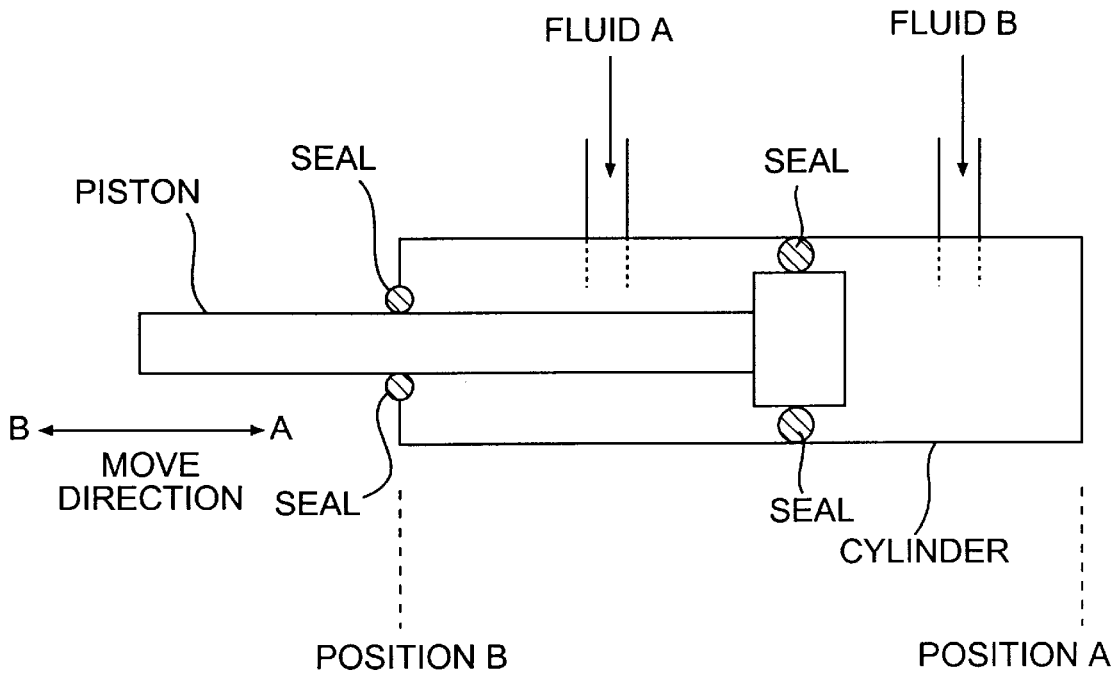
FIG. 1 (PRIOR ART)
FIG. 1 is a schematic diagram of the actuator according to the prior art.
Figure 2B:
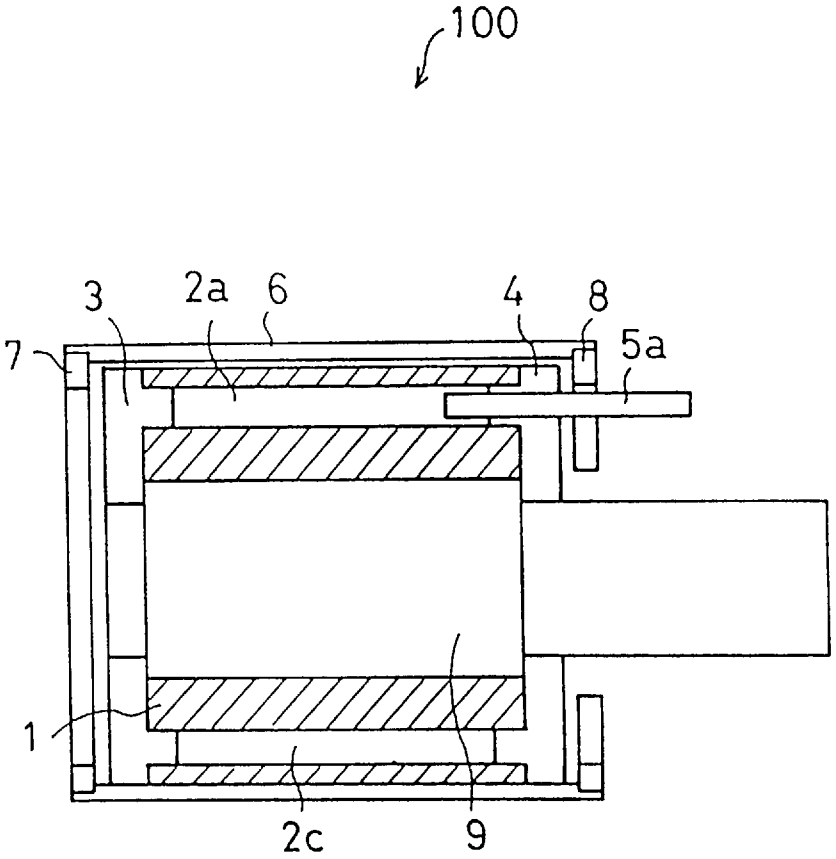
FIG. 2B is a schematic diagram of the horizontal sectional plan of the actuator according to the first embodiment of the present invention.
Figure 2A:
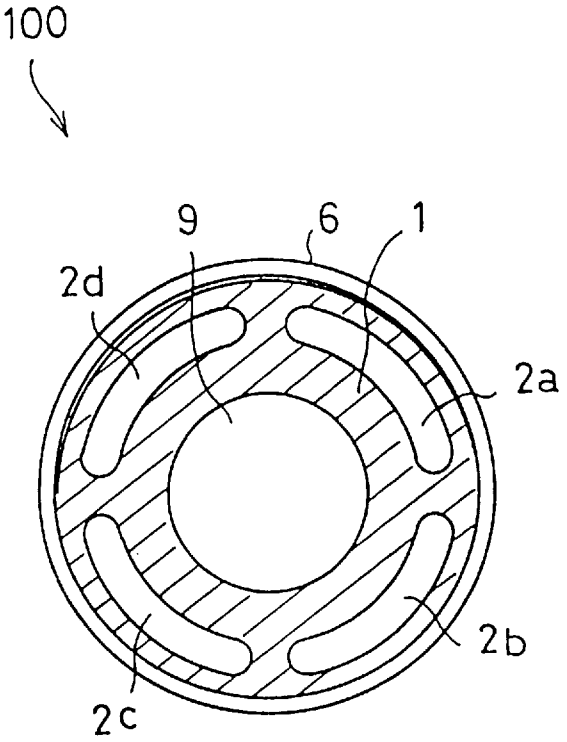
FIG. 2A is a schematic diagram of vertical sectional plan of an actuator according to a first embodiment of the present invention.

FIG. 2A is a vertical sectional plan of the actuator according to the first embodiment of the present invention. FIG. 2B is a horizontal sectional plan of the actuator according to the first embodiment of the present invention. FIGS. 3A, 3B, 3C, 3D, 3E, 3F are schematic diagrams showing activation of the actuator at each timing. In the first embodiment, the actuator is comprised as an outer-rotor type (outer tubular part of the actuator is rotated). As shown in FIGS. 2A and 2B, the actuator 100 includes an elastic body 1 (first structural body) whose material is rubber. The elastic body 1 has a tubular shape and includes four pressure chambers 2*a*, 2*b*, 2*c*, 2*d* at equal interval along the axis direction. One end of the four pressure chambers 2*a*, 2*b*, 2*c*, 2*d* is sealed by a holding member 3, and the other end of the four pressure chambers are sealed by another holding member 4. Four tubes 5*a*, 5*b*, 5*c*, 5*d* respectively connect to the four pressure chambers 2*a*, 2*b*, 2*c*, 2*d* through the holding member 4. The fluid (for example, air, water, oil) is supplied to the four pressure chambers 2*a*, 2*b*, 2*c*, 2*d* from a pressure source (for example, a pump) through an electromagnetic driving valve (for example, a solenoid valve).

A ring-shaped rotor 6 is located around the elastic body 1. In this case, the outer diameter of the elastic body 1 (in a non-pressurized condition) is smaller than the inner diameter of the rotor 6. Therefore, clearance gap exists between the inner surface of the rotor 6 and the outer surface of the elastic body 1. In FIG. 2A, the clearance gap exists in the upper side of the elastic body 1. Therefore, it is possible that the rotor 6 moves in relation to the elastic body 1 and the shape of the elastic body 1 changes elastically (expansion). In order not to pull out the elastic body 1 along the axis direction, two stoppers 7, 8 are fixed to both ends of the rotor 6. A fixed axis 9 is set at the center part of the elastic body 1 to hold the elastic body 1. In this fixed axis 9, the diameter of the end part is shorter than the diameter of the center part along the axis direction. The end parts are respectively connected to holding members 3, 4. The outer surface of the axis is fixed to the elastic body 1 and the holding members 3, 4 by an adhesive. The axis 9 prevents the elastic body 1 from transforming toward center side at pressurization. It is better that the rotor 6 and the holding members 3, 4 consist of material unable to elastically transform (for example, metal or plastic).

Figure 3A:
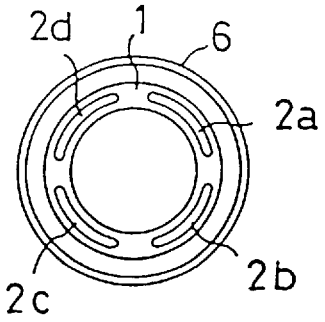
FIGS. 3A, 3B, 3C, 3D, 3E, 3F are schematic diagrams showing activation of the actuator at each timing.

Next, activation of the actuator of the first embodiment is explained by referring to FIGS. 3A–3F. In the present invention, the rotor 6 moves (revolution and rotation) in relation to the elastic body 1 by pressurization of the elastic body 1. Accordingly, rotation output is generated from the actuator. FIG. 3A shows the four pressure chambers 2*a*, 2*b*, 2*c*, 2*d* in a non-pressurization condition. Strictly speaking, relative position between the elastic body 1 and the rotor 6 is not determined because of the clearance gap between the outer surface of the elastic body 1 and the inner surface of the rotor 6. However, in FIG. 3A, the center axis of both the elastic body 1 and the rotor 6 coincides for convenience's sake.

Figure 3D:
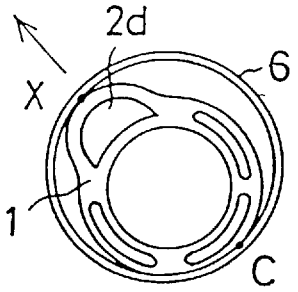
Figure 3B:
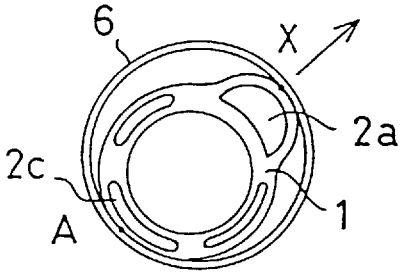

First, only the pressure chamber 2*a* is pressurized as shown in FIG. 3B. In this case, the elastic body 1 is eccentrically moved in the direction of the arrow by elastic transformation. Accordingly, the elastic body 1 contacts the rotor 6 at point X of the outer surface of the pressure chamber 2*a* (Actually, point X is a line extending in the depth direction). In addition to pressurization of the pressure chamber 2*a*, point A whose location is diametrically opposed to point X is another contact point. In this case, the pressure chamber 2*c* is not pressurized. Therefore, the point A is not a contact point between the elastic body 1 and the rotor 6, but a contact point between the rotor 6 and the holding members 3, 4.

Figure 3E:
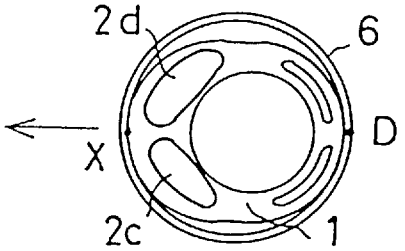
Figure 3C:
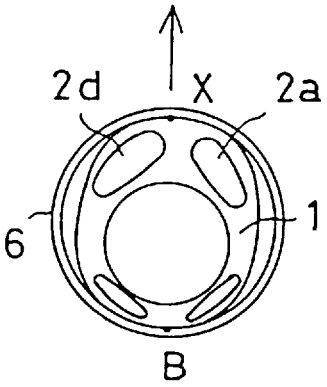

Next, as shown in FIG. 3*c*, the pressure chamber 2*d* is gradually pressurized in order to equal the pressure of pressure chamber 2*a*. In this case, the point X is moved along a counterclockwise rotation. A point B whose location is diametrically to the point X is also a new contact point.

Figure 3F:
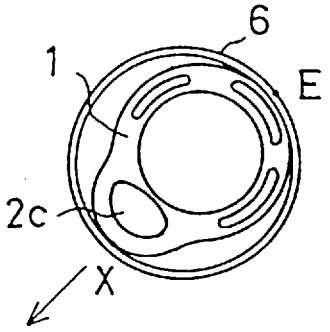

In the same way, as shown in FIGS. 3D, 3E, 3F, the contact point X between the elastic body 1 and the rotor 6 moves along in a counterclockwise rotation through the successive pressurization of the pressure chambers in a counterclockwise rotation. Accordingly, the point diametrically opposed to the contact point X continuausly moves from C to E.

In this way, by successively changing the pressure chamber in the elastic body 1, the contact point X continuously moves on the inner surface of the rotor 6. In short, in case that the elastic body 1 is fixed, the rotor revolves around the center of the elastic body 1 and rotates in a counterclockwise direction. Needless to say, the condition of the elastic body 1 is returned to FIG. 3B if pressurization of the pressure chamber is further executed from the condition of FIG. 3F. Furthermore, if the order of the pressurization is changed to a clockwise rotation, the rotor 6 also rotates in a clockwise direction. The control of the order of the pressurization is executed by a change of programming in the control unit (not shown in FIG.). It is also possible to freely change the rotation speed of the rotor 6 by changing the speed of the order of the pressurization.

Figure 4:
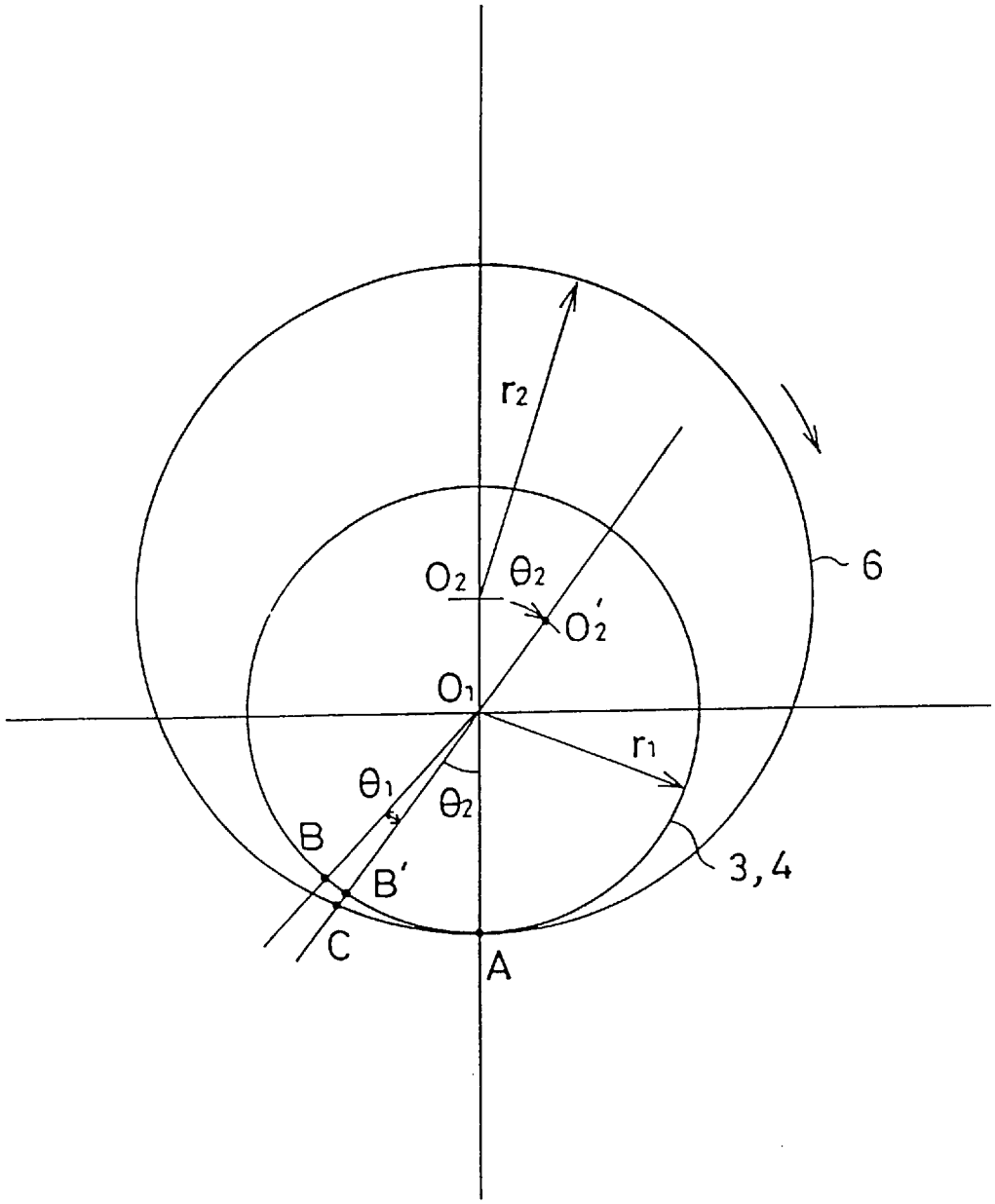
FIG. 4 is a schematic diagram showing the revolution and rotation of the rotor according to the present invention.

FIG. 4 is a schematic diagram showing the revolution and the rotation of the rotor 6 according to the first embodiment. In FIG. 4, the rotor 6 rotates (revolves) along the outer surface of the holding elements 3, 4. In order to simultaneously execute the revolution and the rotation, it is necessary to minimize the amount of sliding on the contact point (A~E in FIG. 3) as much as possible. In this case, friction on the contact point grows large by controlling the pressurization power for the pressure chambers 2*a*, 2*b*, 2*c*, 2*d*. Therefore, it is easy to eliminate the sliding. In FIG. 4, a center point of the holding members 3, 4 is $O_1$, a radius of the holding members 3, 4 is $r_1$, a center point of the rotor 6 is $O_2$, a radius of the rotor 6 is $r_2$. Assume that the sliding is not generated between the holding members 3, 4 and the rotor 6. In this condition, if the rotor 6 revolves as "$\theta_2$" along a clockwise direction and the center point is moved from 02 to $O_2'$, a point C on the inner surface of the rotor 6 contacts with a point B on the outer surface of the holding elements 3, 4. (If the rotor 6 moves as revolution only, the point C contacts with the point B') In short, it is decided that the rotor 6 revolves and rotates along clockwise direction. In this case, if the rotation angle is $\theta_1$, and the length of circular arc AC and the length of circular arc AB are equal, a following equation occurs.

$$r_2\theta_2=r_1(\theta_1+\theta_2)$$

$$\therefore\theta_1=(r_2-r_1)/r_1\cdot\theta_2 \quad (1)$$

In short, if the four pressure chambers 2*a*, 2*b*, 2*c*, 2*d* of the elastic body 1 are successively pressurized to generate the revolution of the rotor 6, the rotation whose speed reduction ratio for revolution angle is $(r_2-r_1)/r_1$ is executed for the rotor 6.

In the first embodiment, the number of the pressure chambers is four. Therefore, pressurization is successively executed 8 times as shown in FIGS. 3A–3E (pressure chamber 2*a*→mid point of pressure chambers 2*a*, 2*d*→pressure chamber 2*d*→mid point of pressure chambers 2*d*, 2*c*→pressure chamber 2*c*→mid point of pressure chambers 2*c*, 2*b*→pressure chamber 2*b*→mid point of pressure chambers 2*b*, 2*a*), 8 district positions per 1 revolution are realized. In this case, if the difference of diameter between the rotor 6 and the holding members 3, 4 is small, the position of the rotation is determined with high accuracy. For example, assume that $r_1$=100 and $r_2$=101. In this case, speed reduction ratio is 1/100 and the resolution of the rotation is 800.

Figure 5B:
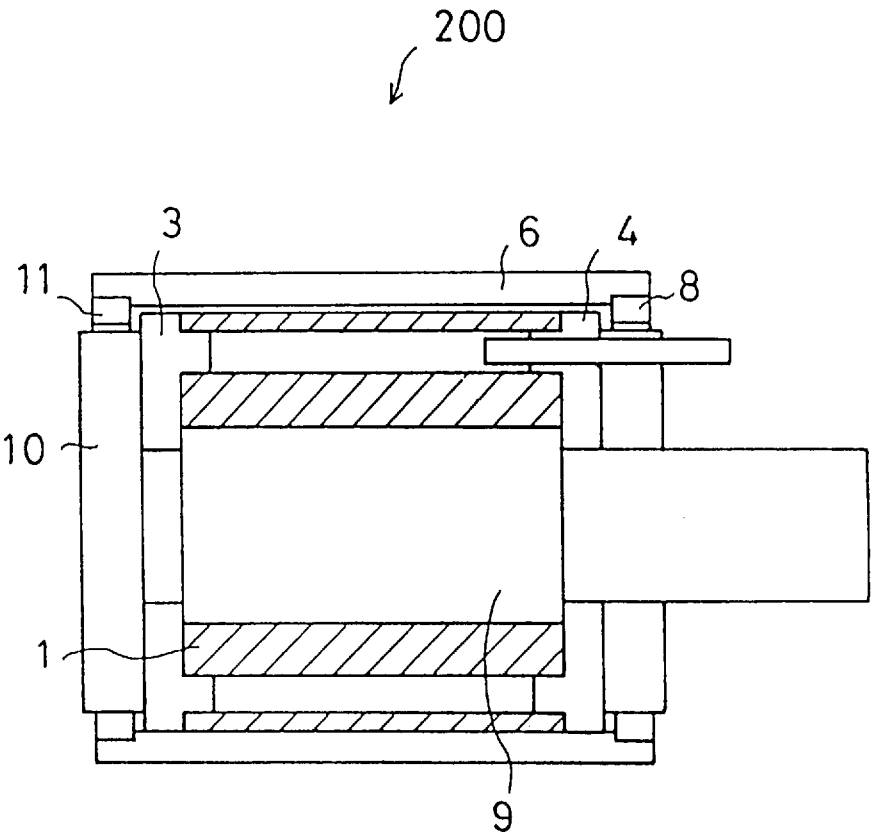
FIG. 5B is a schematic diagram of the horizontal sectional plan of the actuator according to the second embodiment of the present invention.
Figure 5A:
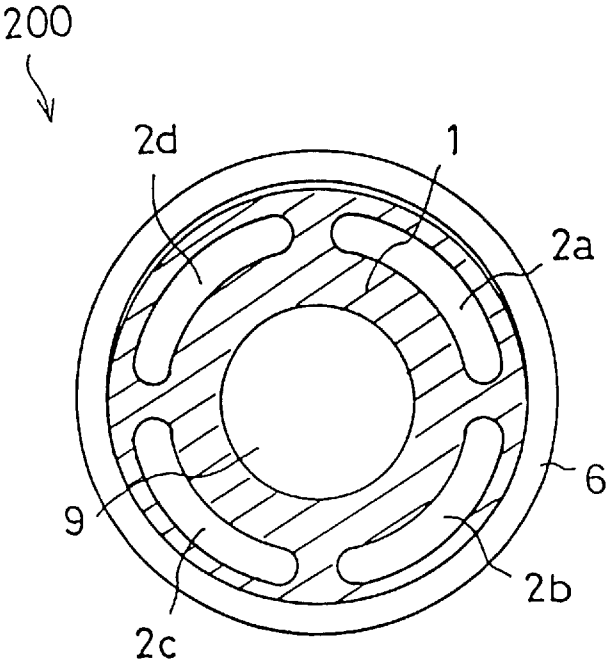
FIG. 5A is a schematic diagram of the vertical sectional plan of an actuator according to a second embodiment of the present invention.

FIG. 5A is a vertical sectional plan of the actuator according to the second embodiment. FIG. 5B is a horizontal sectional plan of the actuator according to the second embodiment. In comparison with the first embodiment, the different feature of the second embodiment is gear set for the elastic body and the rotor to eliminate the sliding. As shown in FIG. 5B, an external gear 10 is attached to the side face of the holding member 3 and the internal gear 11 is set in working position of the external gear 10. The internal gear 11 has the same function as the gear formed on the inner surface of the stopper 7 in the first embodiment. Therefore, if the rotor 6 is eccentrically located by transformation of the elastic body 1, the outer gear 10 and the inner gear 11 are in working position with each other and rotation is generated on the working face. In other words, sliding between the rotor 6 and the holding members 3, 4 is completely eliminated. Even if a large load is activated to the actuator 200, the actuator 200 correctly rotates according to the pressurization pattern As mentioned above, in the first embodiment and the second embodiment, the revolution direction and rotation direction of the rotor 6 is the same.

Figure 6B:
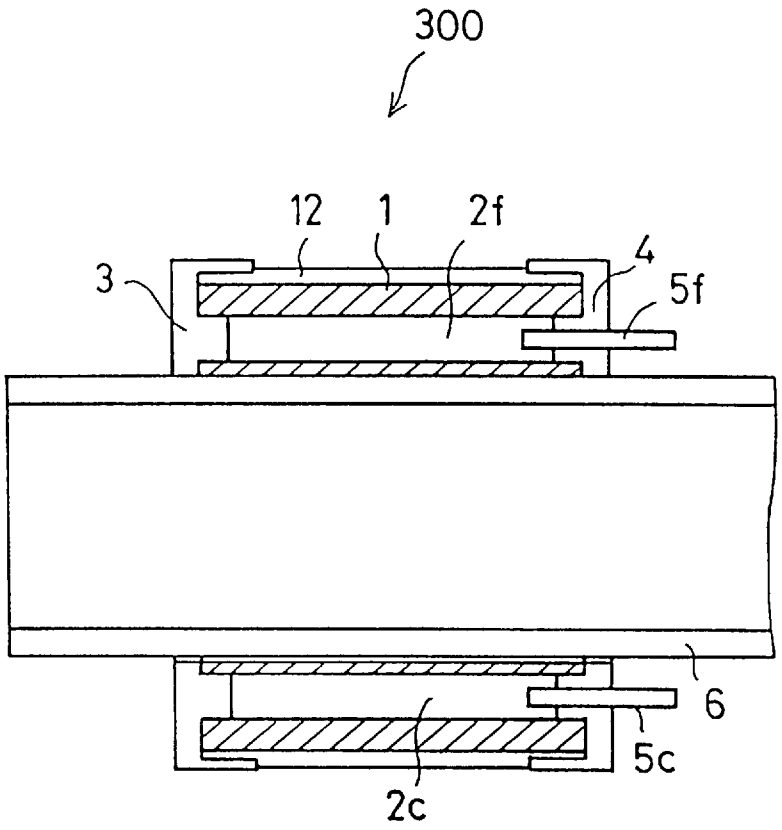
FIG. 6B is a schematic diagram of the horizontal sectional plan of an actuator according to the third embodiment of the present invention.
Figure 6A:
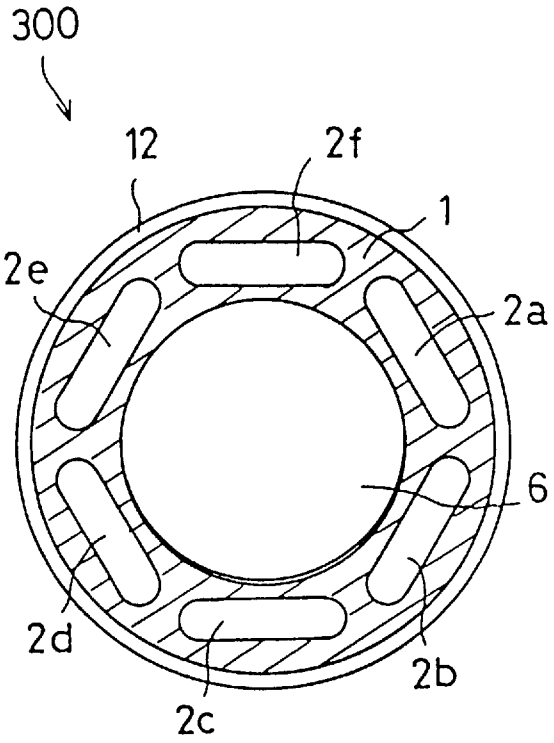
FIG. 6A is a schematic diagram of the vertical sectional plan of the actuator according to a third embodiment of the present invention.

FIG. 6A is a vertical sectional plan of the actuator according to the third embodiment. FIG. 6B is a horizontal sectional plan of the actuator according to the third embodiment. In comparison with the first embodiment and the second embodiment, the different feature of the third embodiment is that the rotor 6 is located on the inner surface of the actuator 300. This is called an inner rotor type (the inner axis is rotated). As shown in FIG. 6A and FIG. 6B, the casing 12 of a tubular shape consisting of a rigid body such as metal or plastic is located to cover the outer surface of the elastic body 1 and is adhesively fixed to the elastic body 1 and the holding members 3, 4. The casing 12 prevents the elastic body 1 from transforming toward the outside (expansion). On the other hand, the rotor 6 passes through the inner surface of the elastic body 1. In this case, outer diameter of the rotor 6 is smaller than inner diameter of the elastic body 1. The rotor 6 may be a hollow cylinder. Furthermore, the number of pressure chambers is not limited to 6 as shown in the pressure chambers 2*a*, 2*b*, 2*c*, 2*d*, 2*e*, 2*f* in FIG. 6A.

When the pressure chambers 2*a*, 2*b*, 2*c*, 2*d*, 2*e*, 2*f* are successively pressurized along one direction, the rotor 6 revolves and rotates along the inner surface of the holding elements 3, 4. Therefore, if the rotation of the rotor 6 is extracted, automatic rotation is generated with high accuracy. In the third embodiment, the revolution direction and rotation direction of the rotor 6 are different (opposite direction).

Figure 7B:
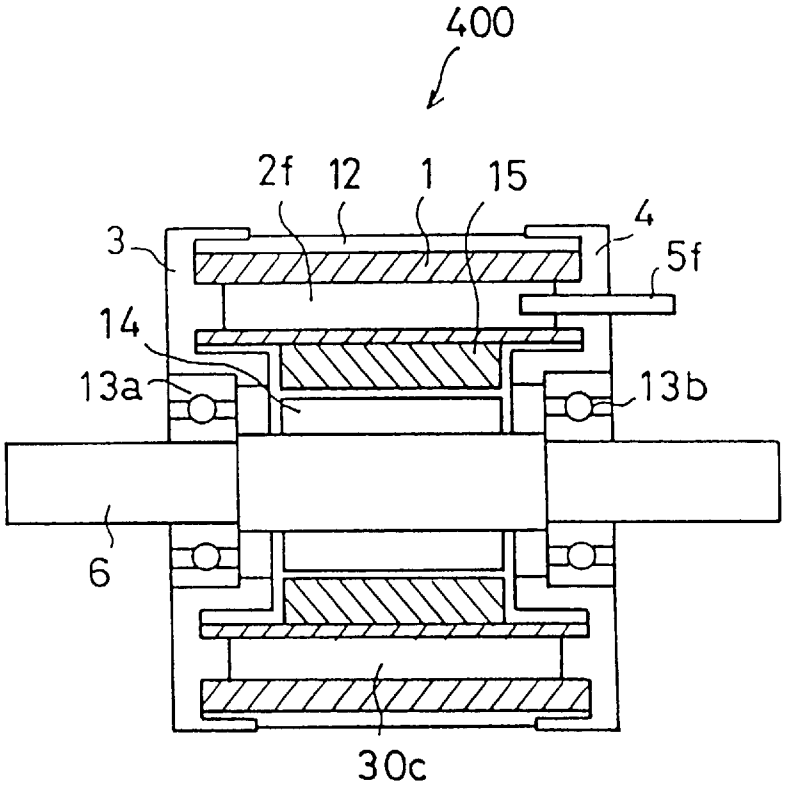
FIG. 7B is a schematic diagram of the horizontal sectional plan of the actuator according to the fourth embodiment of the present invention.
Figure 7A:
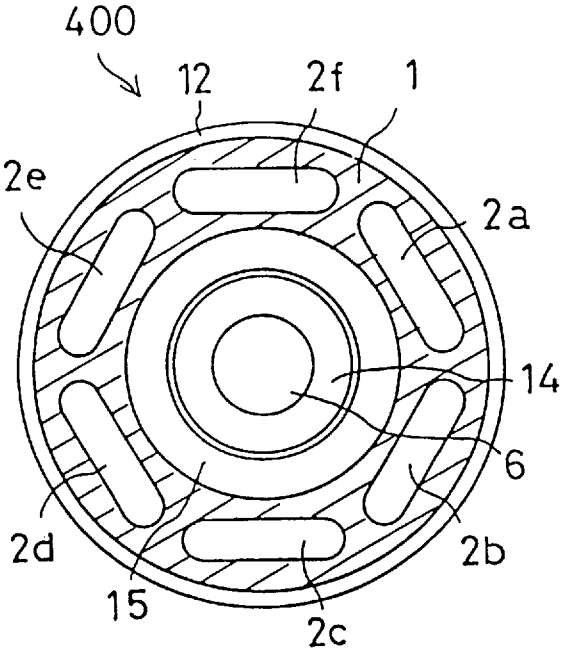
FIG. 7A is a schematic diagram of the vertical sectional plan of the actuator according to a fourth embodiment of the present invention.

FIG. 7A is a vertical sectional plan of the actuator according to the fourth embodiment. FIG. 7B is a horizontal sectional plan of the actuator according to the fourth embodiment. In comparison with the above-mentioned embodiments, the different feature of the fourth embodiment is that the rotor 6 only rotates without revolving. In short, the rotor 6 does not swing on its rotational axis. As shown in FIG. 7B, the rotor 6 is rotationally supported by bearings 13*a*, 13*b* and the external gear 14 is fixed on the center part of the rotor 6. On the other hand, the internal gear 15 is fixed to inner surface of the elastic body 1 in relation to working position of the external gear 14. It is better that the internal gear 15 consists of a rigid body made of metal or plastic. In the fourth embodiment, when the inner surface of the elastic body 1 transforms in the diamatric direction by pressurization, the internal gear 15 moves toward the diameter direction. (In FIG. 7A, non-pressurization status, which represents that a center axis of the external gear 14 coincides with a center axis of the internal gear 15, is shown) In this case, when the pressure chamber 2*f* is pressurized and expanded, the internal gear 15 is pushed and contacts the external gear 14 in working position. Accordingly, if each pressure chamber is successively pressurized, the contact point between the external gear 14 and the internal gear 15 is moved in correspondence with pressurization order of the pressure chamber. As mentioned-above, the rotor 6 is rotationally supported by the bearings 13*a*, 13*b*. Therefore, the rotor 6 rotates only on a rotational axis without revolution.

Figure 8A:
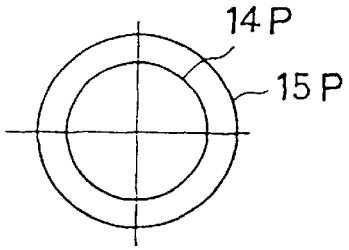
FIGS. 8A, 8B, 8C ,8D ,8E ,8F, 8G are schematic diagrams showing the activation of the actuator at each timing.
Figure 8F:
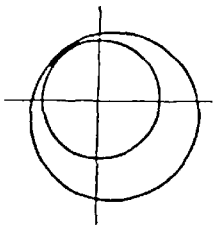

FIGS. 8A, 8B, 8C, 8D, 8E, 8F, 8G shows the activation principle of the actuator 400 according to the fourth embodiment. In FIGS. 8A–8G, the circle 14P represents the pitch of the external gear 14 of the rotor 6 and the circle 15P represents the pitch of the internal gear 15 of the elastic body 1. FIG. 8A shows a status of non-pressurization for all pressure chambers 2*a*, 2*b*, 2*c*, 2*d*, 2*e*, 2*f*In this case, the relative position of the external gear 14 and the internal gear 15 is not determined. However, for convenience's sake, the center axis of the external gear 14 coincides with the center axis of the internal gear 15 in FIG. 8A.

If the pressure chambers 2*a*, 2*b*, 2*c*, 2*d*, 2*e*, 2*f* are sequentially pressurized, the pitch circle 15P of the internal gear 15 revolves around the pitch circle 14P of the external gear 14 as shown in FIG. 8B~FIG. 8G. However, sliding is not generated at a constant point between the external gear 14 and the internal gear 15. In short, when the internal gear 15 revolves, the external gear 14 continuously rotates.

Figure 8B:
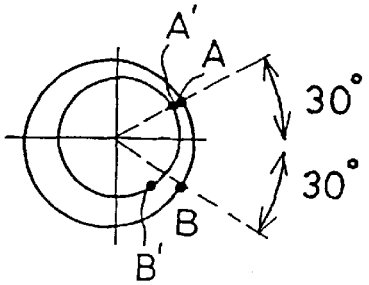
Figure 8G:
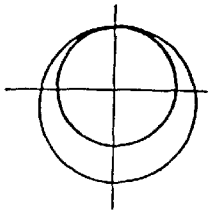
Figure 8C:
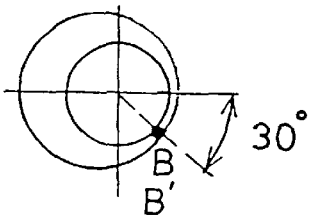
Figure 8D:
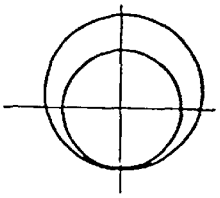
Figure 8E:
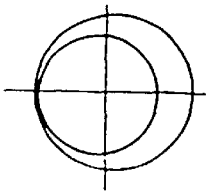

This principle is explained in detail by referring to FIG. 8B and FIG. 8C. First, in FIG. 8B, assume that the contact point between the pitch circle 14P and the pitch circle 15P is respectively A', A, and a point on the pitch circle 14P and the pitch circle 15P is respectively B', B. In the fourth embodiment, point A is separated from point B by 60° because the number of the pressure chambers is 6. In FIG. 8B, if the pitch circle 14P rotates, contacting the pitch circle 15P without sliding, the length of circlular arc AB is equal to the length of circular arc A'B'. Therefore, in FIG. 8B, point B' is separated from point B. On the other hand, in FIG. 8C, the point B' coincides with the point B. In short, the pitch circle 14P (rotor 6) rotates along a counterclockwise direction.

In the fourth embodiment, the rotation is only generated without the revolution from the actuator 400. Therefore, in comparison with the first, second, third embodiments, runout does not occure for the actuator 400 and the rotation of the rotor 6 is useful as the motor.

What is claimed is:

1. An actuator of an outer-rotor type for generating a rotational output, comprising:

an elastic body of substantially fixed length in an axial direction having a plurality of pressure chambers extending along the axial direction and defining an outer surface, a first end and a second end;

a rotor defining an inner surface and surrounding said elastic body and extending in the axial direction with a predetermined gap between the outer surface of said elastic body and said rotor;

a first holding member and a second holding member mounted on the first and second ends of the elastic body respectively and a supply means for sequentially supplying fluid in a supply order to the plurality of pressure chambers, wherein a pressure contact point between the outer surface of said elastic body and the inner surface of said rotor moves in correspondence with the supply order of the fluid to the plurality of pressure chambers to revolve said rotor around the outer surface of said elastic body, wherein said first and second holding members restrict the revolution of said rotor such that said rotor rotates in a direction defined by a progression of the supply order of the fluid.

2. The actuator according to claim 1, further comprising a pressure source to supply the fluid, wherein said supply means comprises a tube connected to said pressure source.

3. The actuator according to claim 1, wherein said elastic body includes an axis at a center portion to fix said elastic body.

4. The actuator according to claim 3, wherein said first and second holding members and said rotor are made of relatively inelastic material and said first and second holding members seal the plurality of pressure chambers within said elastic body.

5. The actuator according to claim 4, further comprising stoppers located at both ends of said rotor so that said elastic body does not shift relative to said rotor along the axial direction.

6. The actuator according to claim 1, wherein the outer surface of said elastic body includes a first gear and the inner surface of said rotor includes a second gear meshed with the first gear.

7. The actuator according to claim 1, wherein said first and second holding members define a first radius ($r_1$), said rotor defines a second radius ($r_2$) and said rotor, when the actuator is operating, rotates at an angular velocity ($\theta_2$) that is defined by the formula $\theta_2=\theta_1 r_1/(r_2-r_1)$ in which $\theta_1$ is an angular velocity of the first and second holding members.

8. An actuator of an inner-rotor type for generating a rotational output, comprising:

an elastic body of substantially fixed length in an axial direction having a tubular shape and a plurality of pressure chambers extending along the axial direction and defining an inner surface, a first end and a second end;

a rotor having an outer surface and positioned within a space defined by the inner surface of the elastic body with a predetermined gap between said elastic body and said outer surface of the rotor, a first holding member and a second holding member mounted on the first and second ends of the elastic body respectively; and a supply means for sequentially supplying fluid in a supply order to the plurality of pressure chambers, wherein a pressure contact point between the inner surface of said elastic body and the outer surface of said rotor moves in correspondence with the supply order of the fluid to the plurality of pressure chambers to revolve said rotor within the inner surface of said elastic body, wherein said first and second holding members restrict the revolution of said rotor such that said rotor rotates in a rotor direction opposite to a direction defined by a progression of the supply order of the fluid.

9. The actuator according to claim 8, further comprising a pressure source to supply the fluid, wherein said supply means comprises a tube connected to the pressure source.

10. The actuator according to claim 8, wherein said rotor has a rotational axis substantially located at a longitudinal axis of said elastic body.

11. The actuator according to claim 10, wherein said first and second holding members and said rotor are made of a relatively inelastic material and said first and second holding members seal the plurality of pressure chambers within said elastic body.

12. The actuator according to claim 11, further comprising a bearing rotationally supporting said rotor within said elastic body.

13. The actuator according to claim 8, wherein the outer surface of said rotor includes a first gear and the inner surface of said elastic body includes a second gear meshed with the first gear.

14. The actuator according to claim 8, wherein said rotor only rotates without sliding relative to the elastic body at a location at which the first gear and the second gear mesh.

* * * * *

UNITED STATES PATENT AND TRADEMARK OFFICE

CERTIFICATE OF CORRECTION

PATENT NO. : 5,879,147
DATED : March 9, 1999
INVENTOR(S) : Koichi SUZUMORI

It is certified that error appears in the above-indentified patent and that said Letters Patent is hereby corrected as shown below:

Title Page, Item [75], in the Inventor, line 1, "Kanagaww-ken" should read --Kanagawa-ken--.

Title Page, Item [57], in the Abstract, line 8, "supples" should read --supplies--.

Claim 1, Col. 6, line 56, after "respectively", insert --;--.

Claim 7, Col. 7, line 24, after "($r_2$)", insert --,--.

Signed and Sealed this

Twenty-eighth Day of September, 1999

*Attest:*

Q. TODD DICKINSON

*Attesting Officer*

*Acting Commissioner of Patents and Trademarks*